US006296116B1

(12) United States Patent
Schmidt et al.

(10) Patent No.: US 6,296,116 B1
(45) Date of Patent: Oct. 2, 2001

(54) GOLF BAG WITH CAM ACTUATED SUPPORT STAND AND DETACHABLE BODY

(75) Inventors: Gregory J. Schmidt, Glendale; John A. Solheim, Phoenix; Gregory M. Suggs, Phoenix; Gary L. Tuerschmann, Phoenix, all of AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/383,706

(22) Filed: Aug. 26, 1999

(51) Int. Cl.[7] ..... A63B 55/00; A63B 55/06

(52) U.S. Cl. ..... 206/315.7; 206/315.3; 248/96

(58) Field of Search ..... 248/96; 206/315.3, 206/315.4, 315.7, 315.8

(56) References Cited

U.S. PATENT DOCUMENTS

| | | | | |
|---|---|---|---|---|
| 846,552 | | 3/1907 | Collins | 248/96 |
| 1,181,007 | | 4/1916 | Henneberg | 248/96 |
| 1,404,559 | | 1/1922 | Watrous | 248/96 |
| 1,410,989 | * | 3/1922 | Borthwick | 248/96 |
| 1,438,311 | * | 12/1922 | Kerlogue | 248/96 |
| 1,471,766 | * | 10/1923 | Wolfe | 206/315.7 X |
| 1,686,774 | | 10/1928 | Sperry | 248/96 |
| 1,738,242 | * | 12/1929 | Gunther | 248/96 |
| 1,746,408 | * | 2/1930 | Stroesser et al. | 248/96 |
| 1,924,182 | * | 8/1933 | Fritz | 206/315.7 X |
| 1,960,099 | * | 5/1934 | Donovan | 206/315.3 X |
| 1,970,849 | | 8/1934 | Gunther | 248/96 |
| 1,978,230 | * | 10/1934 | Schutes | 248/96 |
| 2,661,174 | * | 12/1953 | Sands | 206/315.7 X |
| 3,901,299 | * | 8/1975 | Picco | 206/315.4 |
| 4,506,854 | | 3/1985 | Kim | 248/96 |
| 4,676,464 | | 6/1987 | Reimers | 248/96 |
| 4,778,136 | | 10/1988 | Reimers | 248/96 |
| 4,798,357 | | 1/1989 | Cho | 248/96 |
| 4,834,235 | | 5/1989 | Solheim et al. | 206/315.7 |
| 4,921,192 | | 5/1990 | Jones | 248/96 |
| 5,036,974 | | 8/1991 | Ross | 206/315.7 |
| 5,082,218 | * | 1/1992 | Hoffman | 206/315.7 X |
| 5,139,257 | * | 8/1992 | Wu | 206/315.7 X |
| 5,147,089 | | 9/1992 | Anderson | 248/96 |
| 5,209,350 | | 5/1993 | Maeng | 206/315.7 |
| 5,236,085 | | 8/1993 | Quellais | 206/315.7 |
| 5,339,951 | | 8/1994 | Chen | 206/315.7 |
| 5,390,788 | | 2/1995 | Schenkkan | 206/315.7 |
| 5,397,084 | * | 3/1995 | Wang | 206/315.7 X |
| 5,415,285 | | 5/1995 | Reimers | 206/315.7 |
| 5,497,964 | | 3/1996 | Hagiwara | 248/96 |
| 5,516,064 | | 5/1996 | Hsieh | 248/96 |
| 5,597,144 | | 1/1997 | Lee | 248/96 |
| 5,634,616 | | 6/1997 | Wang et al. | 248/96 |
| 5,662,296 | | 9/1997 | Wu | 248/96 |
| 5,681,016 | | 10/1997 | Wang | 248/96 |

* cited by examiner

*Primary Examiner*—Sue A. Weaver
(74) *Attorney, Agent, or Firm*—Darrell F. Marquette

(57) ABSTRACT

A support stand for use with a golf bag having a body with an open upper end includes a housing mounted on the body. The housing has spaced apart diverging channels formed therein. A pair of support assemblies, each having an arm, are pivotally mounted in the channels for movement between retracted and extended positions. A leg is connected to each arm. The support assemblies are spring loaded to urge them into the retracted position, and a cam lever is pivotally mounted on the housing. When the cam lever is depressed into actuating engagement with the arms, the support assemblies are moved into their extended positions and the legs support the body in a propped-up position.

14 Claims, 4 Drawing Sheets

GOLF BAG WITH CAM ACTUATED SUPPORT STAND AND DETACHABLE BODY

BACKGROUND OF THE INVENTION

This invention relates in general to golf equipment and, more particularly, to a golf bag with a cam actuated support stand and a detachable body.

Golf bags are normally provided with a shoulder strap by which a golfer carries the bag between golf shots and, when arriving at the spot where another shot is to be made, the bag is removed from the golfers shoulder and set on the ground in a generally upright position while a club is selected for the next shot. When the club selection has been made, the golfer lays the bag flat on the ground unless the bag is equipped with some type of stand that holds the bag in a propped-up position. Stands for that purpose have become very popular and many different types have been used.

One type of prior golf bag stand includes a pair of legs that are pivotally mounted for cooperating with an elongated rod depending from the legs to an actuator device located at the bottom of the bag. The legs are moved to an extended position when the actuator device is brought into contact with the ground. An elastic band is used to urge the legs into a retracted position when the bag is lifted off of the ground. A stand of this type is disclosed in U.S. Pat. No. 5,209,350 to S Maeng. Another type of prior golf bag stand also includes a pair of legs pivotally mounted for movement between extended and retracted positions. The lower ends of a shoulder strap used for carrying the bag are attached to the legs so that when the bag is lifted by the shoulder strap, the legs will be pulled to the retracted position. Elastic straps are used to move the legs into the extended position when the bag is set on the ground and the shoulder strap is released. This type of stand is described in U.S. Pat. No. 4,778,136 to E. Reimers.

A further golf bag stand disclosed in U.S. Pat. No. 4,834,235 to J. A. Solheim et al is provided with a pair of legs pivotally mounted at their upper ends and an actuator rod which is connected to the legs below their upper ends. The legs and actuator rod operate as a toggle mechanism moving the legs between extended and retracted positions. The golf bag is configured so that a longitudinally extending side of its body is partially collapsible. The operating force which moves the legs and the actuating rod in the manner of a toggle mechanism to extend the legs will automatically occur when a partial collapsing of the golf bag body takes place upon setting the body down in a vertical position and leaning it over slightly in the direction of its collapsible side. The legs will be moved to the retracted position when the body is picked up and the collapsible side is restored to its normal state. This golf bag stand has proven to be very reliable and is commercially successful.

U.S. Pat. No. 5,497,964 to S. Hagiwara discloses another golf bag stand having a pair of legs pivotally mounted on opposite ends of a block which is attached by a strap. Each leg has an extension that is connected thereto below its the pivot mounting on the block. A handgrip is supported between upper ends of the extensions, and springs urge the extensions apart thereby biasing the legs into retracted positions. The legs may be extended by squeezing the grip against the top rim of the golf bag.

SUMMARY OF THE INVENTION

In accordance with the present invention, a support stand for use with a golf bag is disclosed. The golf bag has a body with an open upper end through which golf clubs may be inserted and removed. The support stand includes a housing having spaced apart diverging channels formed therein and having a top member that maintains the open upper end of the body. A pair of support assemblies, each including an arm with a leg extending therefrom, are mounted in the channels and are pivotally movable between retracted and extended positions. In the extended position of the support assemblies, the legs support the body in a propped-up position. Each of the support assemblies is spring loaded to urge it into its retracted position where the arm thereof is positioned so that a cam surface formed on the end of the arm is disposed above the housing. A cam lever is pivotally mounted on the housing and, when the cam lever is depressed, engages the cam surfaces on the arms. This movement of the cam lever moves the support assemblies into their extended positions so that the body is supported by the legs in its propped-up position. The golf bag includes a top member for maintaining the open upper end of the body. Fastener means are provided for detachably connecting the body to the top member.

DESCRIPTION OF THE PREFERRED EMBODIMENT

Figure 1:
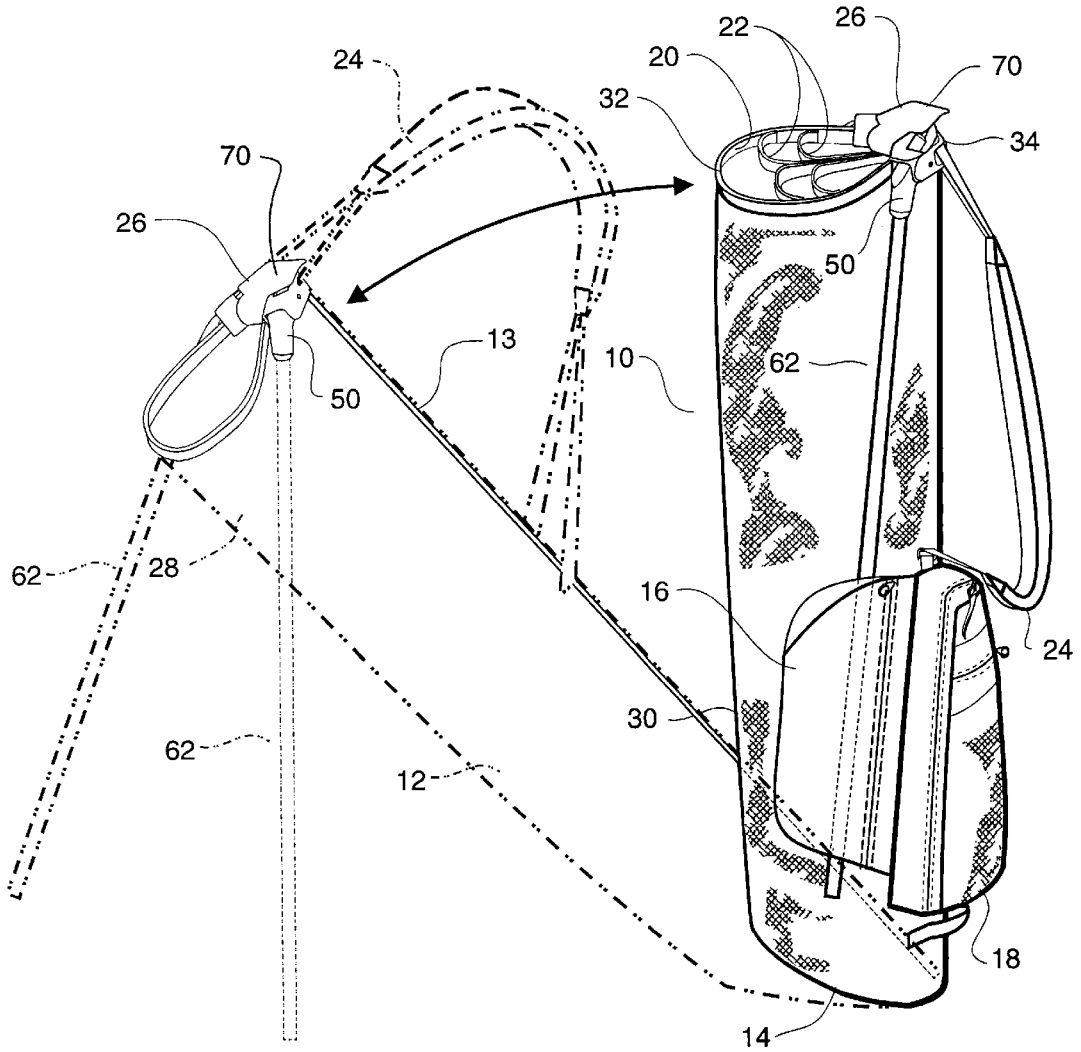
FIG. 1 is a perspective view of a golf bag including a support stand according to the present invention.

Referring to FIG. 1, a golf bag indicated generally by the reference numeral 10 includes a body 12 which is preferably formed of a suitable fabric such as nylon with a closed bottom end 14 and pockets 16, 18. The body 12 has an open upper end 20 through which golf clubs (not shown) are inserted and removed, a divider structure 22 in the open upper end 20, and a carrying strap 24. The golf bag 10 also includes a support stand 26 according to the present invention mounted adjacent the open upper end 20 of the body 12. The support stand 26 is movable between an extended position wherein the body 12 is in a propped-up position 28 shown in broken lines, and a retracted position wherein the body 12 is in a carrying position 30 shown in solid lines. A rigid member 13 extends between the closed bottom end 14 and the open upper end 20 of the body 12.

Figure 2:
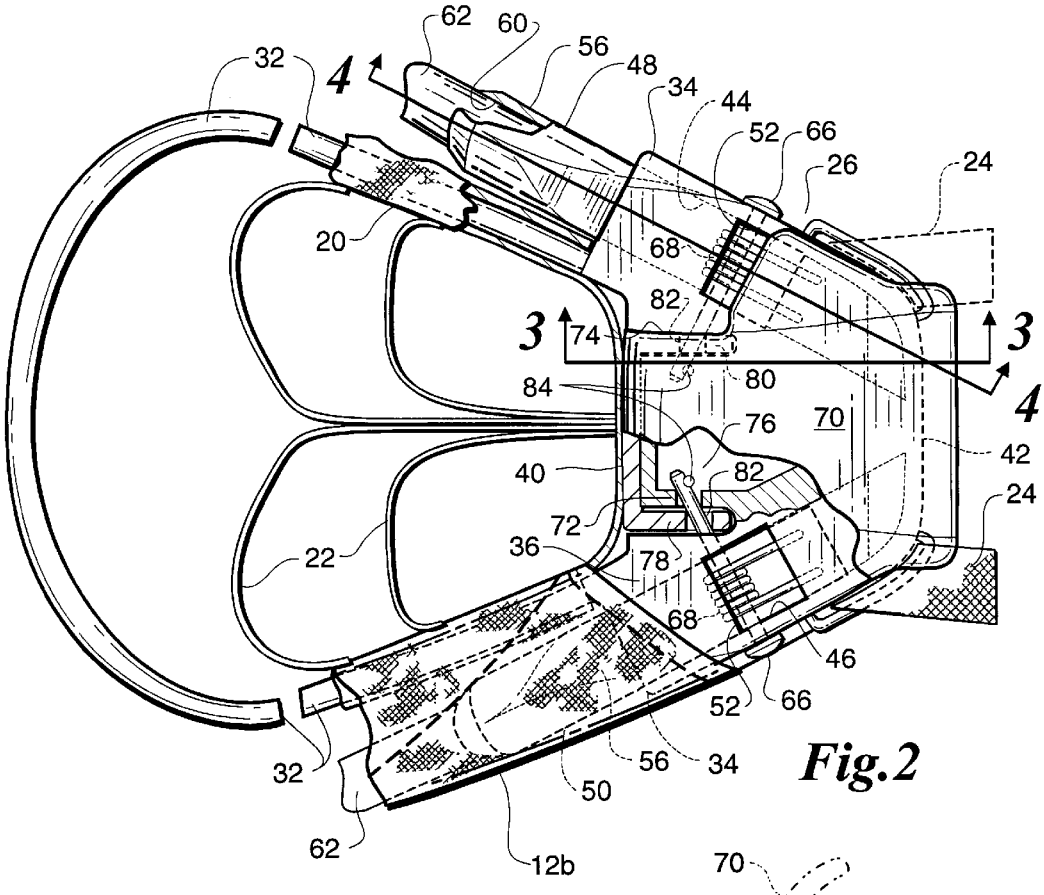
FIG. 2 is an enlarged plan view of the golf bag support stand of the present invention with portions thereof broken away.
Figure 3:
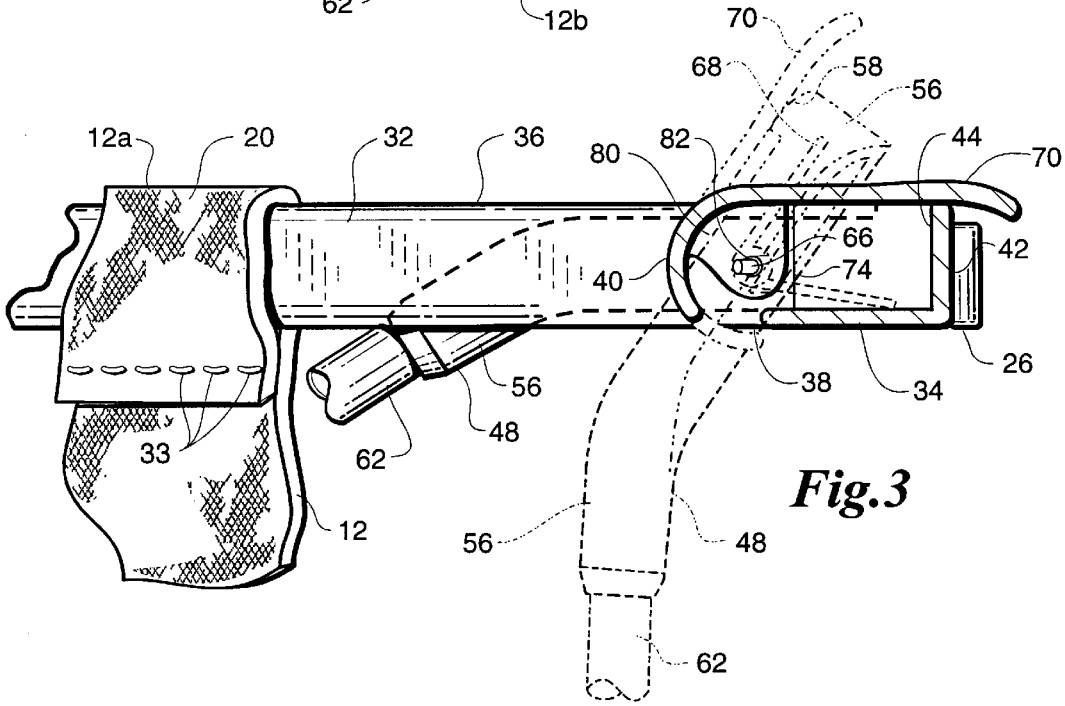
FIG. 3 is a fragmentary sectional view taken along the line 3—3 in FIG. 2.

As also seen in FIGS. 2 and 3, the golf bag 10 includes a top member 32 to which the body 12 is suitably attached such as by wrapping an upper end 12*a* of the body 12 about the top member 32 and securing it by utilizing stitching 33 seen in FIG. 3. The top member 32 serves a dual purpose in that it maintains the open upper end 20 of the body 12 while providing means on which the support stand 26 is mounted. In the preferred embodiment, the top member 32 is a closed loop that extends between spaced apart locations on a housing 34. The housing 34, when mounted on the body 12, lies adjacent the open upper end 20. When the body 12 is in its carrying position 30, the housing 34 has a top wall 36, a bottom wall 38, an inner end 40 and an outer end 42. The housing 34 is formed with a pair of channels 44, 46 between the top and bottom walls 36, 38 along opposite sides of the housing 34. The channels 44, 46 are arranged to diverge from each other as they extend from the outer end 42 toward the inner end 40. A pair of support assemblies 48 and 50 pivotally mounted respectively in the channels 44 and 46 are movable between retracted positions and extended positions. The upper end 12*a* of the body 12 has extensions 12*b* (FIG. 2) that partially cover the channels 44, 46 adjacent the housing inner end 40. It is understood that the channels 44, 46 and the support assemblies 48, 50 mounted therein are mirror images of each other and operate in the same manner. Therefore, only the channel 44 and its associated support assembly 48 will be described.

Figure 4:
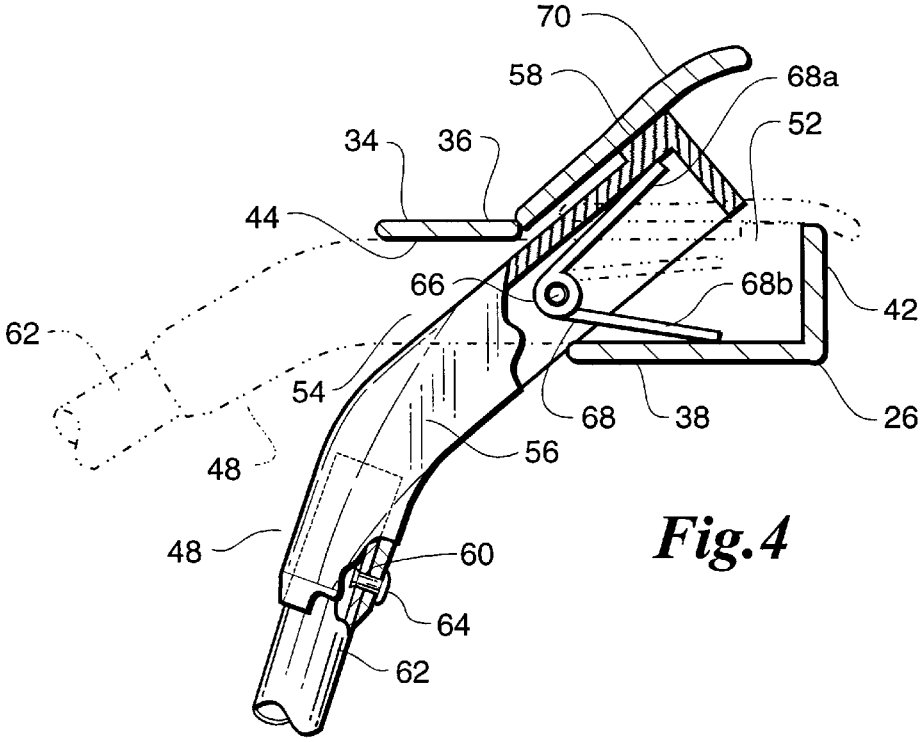
FIG. 4 is a fragmentary sectional view taken along the line 4—4 in FIG. 2.

As seen best in FIG. 4, an opening 52 provided in the housing top wall 36 extends from the housing outer end 42 toward the housing inner end 40. Another opening 54 formed in the housing bottom wall 38 adjacent the inner wall 40 is partially offset from the opening 52. The support assembly 48 includes an arm 56 having a cam surface 58 formed on one end and a bore 60 formed in its opposite end. An elongated leg 62 is secured in the bore 60 by conventional means such as epoxy adhesive or a pin 64 shown in FIG. 4. The arm 56 is mounted in the channel 44 on a pivot pin 66 and is disposed so that the cam surface 58 is proximate the opening 52 in the housing top wall 36. The end of the arm 56 containing bore 60 extends through the opening 54 in the housing bottom wall 38. The arm 56 is movable about the pivot pin 66 to provide the retracted and extended positions of the support assembly 48.

In the retracted position of the support assembly 48 shown in solid lines in FIG. 4, the cam surface 58 on the arm 56 extends through the opening 52 in the housing top wall 36 and the arm 56 depends from the housing 34 through the opening 54 in the bottom wall 38 thereof As shown in FIG. 4, a coil spring 68 is mounted coaxially on the pivot pin 66 with one end 68*a* thereof in bearing engagement with the arm 56 adjacent the cam surface 58 and the other end 68*b* in bearing engagement with the housing bottom wall 38 to bias the support assembly 48 into its retracted position. In the extended position of the support assembly 48, the arm 56 is pivotally moved so that the cam surface 58 is flush with the top wall 36 of the housing 34 and the arm 56 does not extend through the opening 54 in the housing bottom wall 38. The leg 62 is rotated from the retracted position shown in solid lines in FIG. 4 where it is disposed alongside the body 12 to the extended position shown in broken lines where it is disposed angularly with respect to the body 12.

A cam lever 70 is mounted on the housing 34 for actuating engagement with the cam surfaces 58. The cam lever 70 is pivotally movable between a substantially upstanding position shown in broken lines in FIG. 3 and a depressed position shown in solid lines. As shown in FIG. 2, the pivot pins 66, which are used to mount the arms 56 of the support assemblies 48, 50 in their respective channels 44, 46, extend through a pair of interior walls 72, 74 formed adjacent the inner end 40 of the housing 34. The interior walls 72, 74 are parallel to each other and are separated from each other by a downwardly opening cavity 76. The cam lever 70 is provided with a spaced apart pair of depending lugs 78 and 80 which are disposed adjacent the interior walls 72 and 74, respectively, of the housing 34. The pivot pins 66 pass through holes 82 formed in the lugs 78, 80 and into the cavity 76 where they are secured by suitable mechanical fasteners such as cotter pins 84. Thus, the support assemblies 48, 50 and the cam lever 70 are all mounted in their respective positions by the pivot pins 66 and are movable about the pivot pins 66.

It will understood that when both of the support assemblies 48 and 50 are urged into their retracted positions by the coil springs 68, the cam surfaces 58 on the arms 56 bear against the underside of the cam lever 70 thereby holding the cam lever 70 in its substantially upstanding position. When a golfer removes the golf bag 10 from his shoulder and rests it on the ground, one of the golfer's hands will be placed at the open upper end 20 of the body 12 overlaying the cam lever 70. Then, by leaning the body 12 toward the propped-up position 28 shown in broken lines in FIG. 1, the golfer's hand will engage the cam lever 70 and push it downwardly into its depressed position thereby moving the support assemblies 48, 50 into their extended positions. This hand activated movement of the cam lever 70 and the support assemblies 48, 50 moves the legs 62 into their extended positions shown in broken lines in FIG. 1 thereby supporting the body 12 in its propped-up position 28.

Figure 5:
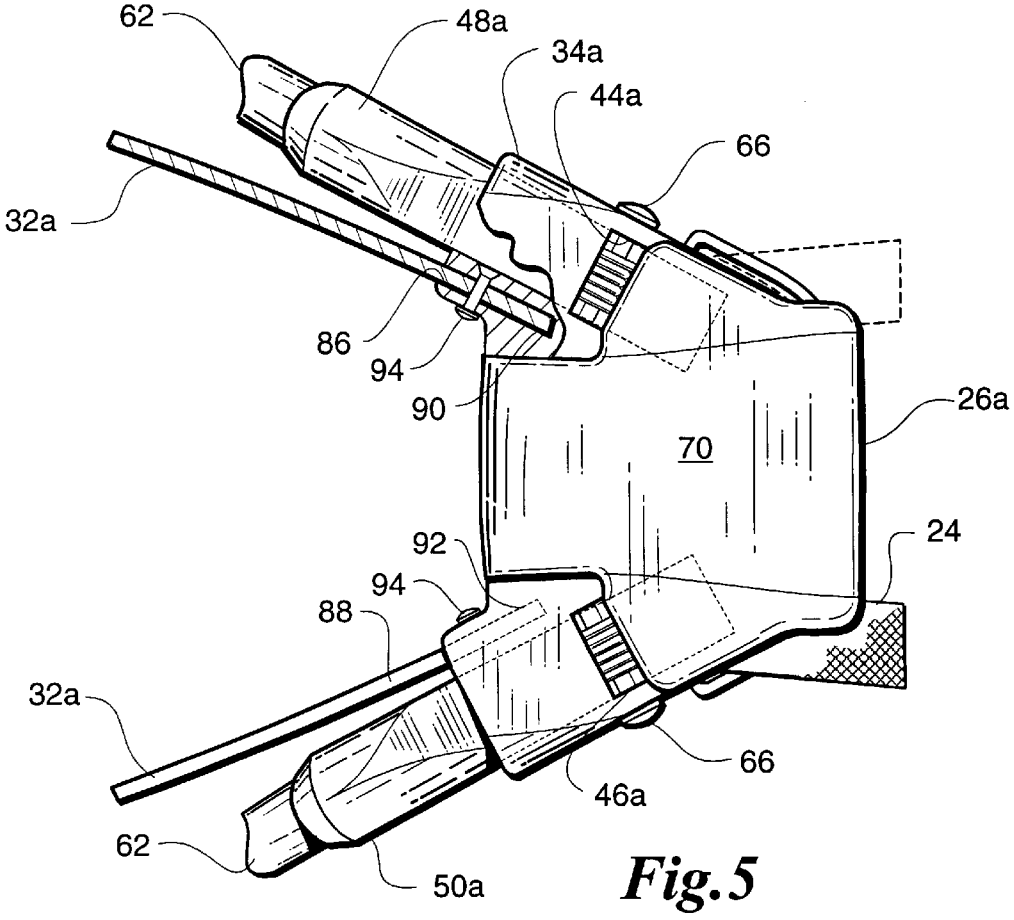
FIG. 5 is a fragmentary view similar to FIG. 2 of a modified golf bag support stand with portions broken away.

As seen in FIG. 2, the top member 32 may be integrally formed with the housing 34. However, a modified support stand 26*a* shown in FIG. 5 may be employed if golf bags having different size open upper ends are to be used. In the modified support stand 26*a,* the housing 34*a* is formed with a pair of grooves 86 and 88 which are adjacent and parallel to channels 44*a* and 46*a*. The opposite ends 90 and 92 of a top member 32*a* are inserted into the grooves 86 and 88, respectively, and are secured therein by rivets 94. In the modified support stand 26*a,* the legs 62 are received in support assemblies 48*a,* 50*a* that are similar to support assemblies 48, 50.

Figure 6:
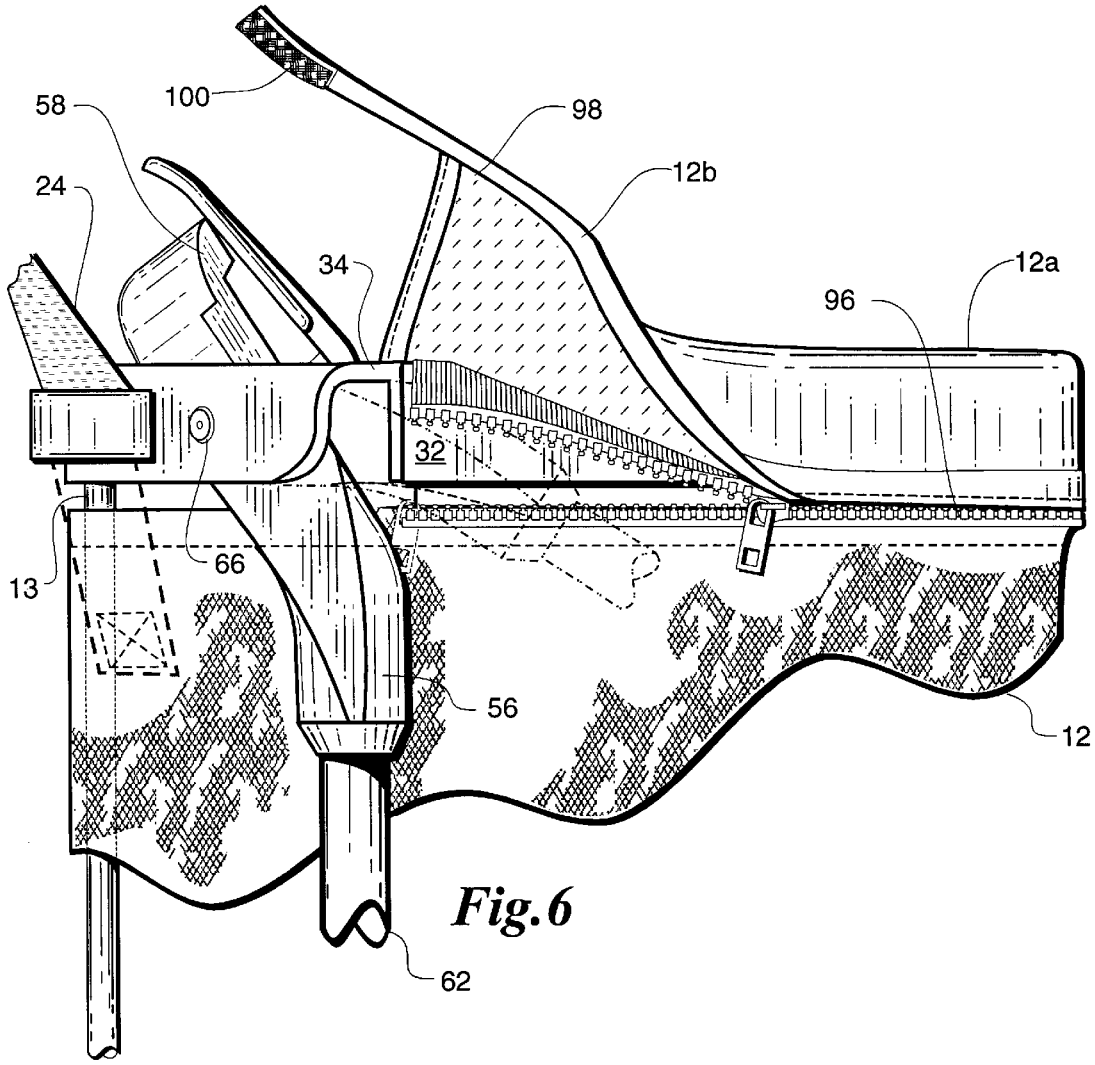
FIG. 6 is a sectional view similar to FIG. 3 showing a further feature of the golf bag.

Referring to FIG. 6, the upper end 12*a* of the body 12 is provided with a zipper fastener 96 for detachably connecting the body 12 to the top member 32. The zipper fastener 96 is substituted for the stitching 33 shown in FIG. 3. By utilizing the zipper fastener 96, the body 12 may be replaced by another body (not shown) of different style, configuration or color as desired. At each end of the zipper fastener 96, a strap 98 is provided with fastener material 100 such as Velcro. The straps 98 are attached to each other adjacent the outer end 42 of the housing 34 in order to prevent the zipper fastener 96 from opening inadvertently.

What is claimed is:

1. A support stand for use with a golf bag having a body with an open upper end, said support stand comprising:

a housing mounted on said body adjacent the open upper end, said housing having a top wall, a bottom wall, an inner end and an outer end, said housing also having a pair of channels formed therein and diverging from each other as they extend from the housing outer end toward the housing inner end, each of said channels having an opening formed in the top wall of said housing adjacent the outer end thereof;

a pair of support assemblies each having a cam surface formed thereon and a leg connected thereto, said support assemblies being mounted in said channels for pivotal movement between an extended position wherein the cam surfaces are disposed in said channels and a retracted position wherein the cam surfaces extend through said openings in said channels a pair of springs mounted in the pair of channels, said springs being disposed in engagement with said support assemblies for urging said support assemblies into said retracted positions; and a cam lever pivotally mounted on said housing for actuating engagement with the cam surfaces on said support assemblies, said cam lever being in a substantially upright position when said support assemblies are in said retracted positions and being movable to push the cam surfaces on said support assemblies downwardly into said channels thereby moving said support assemblies into said extended positions so that said legs support said body in a propped-up position.

2. The support stand of claim 1, wherein said channels are formed on opposite sides of said housing.

3. The support stand of claim 2, further comprising a top member extending from the inner end of said housing for attaching the open upper end of the body thereto.

4. The support stand of claim 3, wherein said top member forms a loop that extends from the inner end of said housing.

5. The support stand of claim 4, wherein said housing has a pair of spaced apart grooves formed therein, and said top member has opposite ends mounted in said grooves.

6. The support stand of claim 1, wherein each of said pair of support assemblies comprises an arm having the cam surface formed on one end thereof and having a bore formed in the other end; and wherein said legs are mounted in said bores.

7. The support stand of claim 6, wherein another opening is formed in the bottom wall of said housing adjacent the inner end thereof, and wherein said other ends of said arms and said legs extend through said another openings in said channels when said support assemblies are in the retracted positions.

8. The support stand of claim 1, further comprising:

said housing having a spaced apart pair of interior walls formed adjacent the inner end of said housing;

said cam lever having a pair of depending lugs disposed adjacent said interior walls; and a pair of pivot pins each extending through one of said channels for pivotally mounting said support assemblies in their respective channels, each of said pivot pins also extending through one of said interior walls and through one of said lugs for pivotally attaching said cam lever to said housing.

9. The support stand of claim 1, further comprising:

a pair of pivot pins each extending through one of said channels for pivotally mounting said support assemblies in their respective channels; and said springs each being a coil spring mounted coaxially on one of said pivot pins and each having one end in bearing engagement with said housing and the other end in bearing engagement with one of said support assemblies.

10. The support stand of claim 1, wherein said body comprises extensions at the open upper end that at least partially cover said channels adjacent the housing inner end.

11. A support stand for use with a golf bag having a body with an open upper end, said support stand comprising:

a housing mounted on said body adjacent the open upper end, said housing having a top wall and a channel, said channel including an opening formed in said housing top wall;

a support assembly mounted in said housing channel, said support assembly having a cam surface;

a leg connected to said support assembly for supporting said body in a propped-up position;

a cam lever mounted on said housing for actuating engagement with said cam surface on said support assembly for moving said support assembly from a retracted position where said cam surface extends through said opening in said channel and where said leg is disposed alongside said body to an extended position where said cam surface is disposed in said channel and where said leg is disposed angularly with respect to said body; and said leg supporting said body in said propped-up position when said support assembly is in said extended position.

12. The support stand of claim 11, further comprising a spring disposed for urging said support assembly into said retracted position.

13. The support stand of claim 11, further comprising a top member for maintaining the open upper end of said body.

14. The support stand of claim 13, further comprising fastener means for detachably connecting said body to said top member.

* * * * *